US009090416B2

(12) United States Patent
Nakamura

(10) Patent No.: US 9,090,416 B2
(45) Date of Patent: Jul. 28, 2015

(54) PAPER FEED APPARATUS, IMAGE FORMING APPARATUS AND IMAGE FORMING SYSTEM

(71) Applicant: Konica Minolta, Inc., Tokyo (JP)

(72) Inventor: Hajime Nakamura, Hachioji (JP)

(73) Assignee: KONICA MINOLTA, INC. (JP)

( * ) Notice: Subject to any disclaimer, the term of this patent is extended or adjusted under 35 U.S.C. 154(b) by 0 days.

(21) Appl. No.: 14/230,498

(22) Filed: Mar. 31, 2014

(65) Prior Publication Data

US 2014/0312556 A1 Oct. 23, 2014

(30) Foreign Application Priority Data

Apr. 17, 2013 (JP) ..... 2013-086393

(51) Int. Cl.

| | |
|---|---|
| ***B65H 3/44*** | (2006.01) |
| ***B65H 5/26*** | (2006.01) |
| ***B65H 9/00*** | (2006.01) |
| ***B65H 1/28*** | (2006.01) |
| ***B65H 1/04*** | (2006.01) |
| ***G03G 15/00*** | (2006.01) |

(52) U.S. Cl.

CPC ..... *B65H 9/004* (2013.01); *B65H 1/04* (2013.01); *B65H 1/28* (2013.01); *B65H 3/44* (2013.01); *G03G 15/6508* (2013.01)

(58) Field of Classification Search

CPC ..... B65H 9/00; B65H 9/004; B65H 9/006; B65H 3/44; G03G 15/6508

USPC ..... 271/9.01, 9.02, 9.05, 9.06, 9.11–9.13, 271/226, 227, 242, 245, 246

See application file for complete search history.

(56) References Cited

U.S. PATENT DOCUMENTS

| | | | | |
|---|---|---|---|---|
| 7,677,549 | B2 * | 3/2010 | Kosugi | 271/9.13 |
| 7,841,590 | B2 * | 11/2010 | Adachi et al. | 271/9.09 |
| 2009/0256303 | A1 * | 10/2009 | Adachi et al. | 271/9.01 |
| 2010/0225046 | A1 * | 9/2010 | Seto et al. | 271/9.01 |

FOREIGN PATENT DOCUMENTS

| | | | | |
|---|---|---|---|---|
| JP | 62136442 A | * | 6/1987 | B65H 3/44 |
| JP | 04060557 A | | 2/1992 | |
| JP | 04064550 A | * | 2/1992 | B65H 7/06 |

(Continued)

OTHER PUBLICATIONS

Japanese Rejection Notice corresponding to Patent Application No. 2013-086393; Dispatch Date: Feb. 24, 2015, with English translation.

*Primary Examiner* — Prasad Gokhale

(74) *Attorney, Agent, or Firm* — Cantor Colburn LLP

(57) ABSTRACT

A paper feed apparatus capable of properly feeding various types of sheets is described. The paper feed apparatus includes a plurality of paper feed units, and a control unit which determines the printing suitability of a combination of the sheet and the paper feed unit on the basis of the size and stiffness of the sheet stored in the paper tray. Each of the paper feed units includes a paper tray, a paper feeding device for feeding sheets, and conveyance rollers for conveying sheets fed from the paper feeding device. The plurality of paper feed units include at least one first paper feed unit configured in order that a sheet enters the conveyance rollers through a conveying route which is curved, and at least one second paper feed unit configured in order that a sheet enters the conveyance rollers through a conveying route which is linear.

30 Claims, 4 Drawing Sheets

(56) References Cited

FOREIGN PATENT DOCUMENTS

| | | | |
|---|---|---|---|
| JP | S5396847 | U | 1/1997 |
| JP | 09194084 | A | 7/1997 |
| JP | 2005015215 | A | 1/2005 |
| JP | 2011008044 | A | 1/2011 |

* cited by examiner

Fig. 4

| PAPER SIZE (width x length) | STIFFNESS | | |
|---|---|---|---|
| | large | medium | small |
| A5 (148×210) | A | A | A/B |
| A5 (210×148) | A | A/B | A/B |
| A4 (210×297) | A | A/B | A/B |
| A4 (297×210) | A | A/B | B |
| A3 (297×420) | A | A/B | B |

PAPER FEED APPARATUS, IMAGE FORMING APPARATUS AND IMAGE FORMING SYSTEM

CROSS-REFERENCE TO RELATED APPLICATIONS

The present application claims priority under 35 U.S.C. g119 to Japanese Patent Application No. 2013-086393, filed on Apr. 17, 2013. The contents of this application are herein incorporated by reference in their entirety.

FIELD OF THE INVENTION

The present invention relates to a paper feed apparatus, an image forming apparatus and an image forming system.

DESCRIPTION OF THE RELATED ART

In recent years, image forming systems are known which are capable of successively performing various treatments for paper. This image forming system includes one or more such apparatuses which are connected in series in accordance with the specifications required of the system. The apparatuses for constructing the image forming system include, for example, an image forming apparatus for performing image formation, a large volume paper feed apparatus capable of storing a number of sheets and feeding the sheets to the image forming apparatus, and so forth.

The large volume paper feed apparatus includes a paper feed unit provided with a paper tray for storing a number of sheets and a feeding device for feeding sheets from the paper tray, and a conveyance unit for conveying sheets fed from the feeding device to an apparatus located in the downstream side along a conveying route. On the other hand, since the image forming apparatus can be used alone, a paper feed apparatus is provided therein for conveying a sheet to a position where an image forming process is performed.

For example, Japanese Patent Published Application No. H09-194084 discloses an image forming apparatus provided with a plurality of paper feed trays. This image forming apparatus includes a nudger roller for pulling out sheets stored in a paper feed tray, and feed and separation rollers for conveying the sheets pulled through the nudger roller.

The conveying route of this image forming apparatus is implemented as a linear route from the nudger roller to the feed and separation rollers. This configuration is common to the conveying routes provided for all the paper feed trays. Such a linear route cannot sufficiently control the position of a sheet, depending on the type of sheet, and thereby tends to render the orientation of a sheet unsteady. Because of this, while a sheet tends to lift up, the sheet may be folded or wrinkled when arriving at the subsequent feed and separation rollers in a misaligned state. As a result, there is a problem that the conventional image forming apparatus is not suitable for handling various types of sheets.

The present invention has been made in order to solve the problems as described above. It is an object of the present invention therefore to provide a paper feed apparatus, an image forming apparatus and an image forming system which can be used for handling various types of sheets.

SUMMARY OF THE INVENTION

To achieve at least one of the abovementioned objects, a paper feed apparatus reflecting one aspect of the present invention comprises: a plurality of paper feed units each of which includes a paper tray, a paper feeding device configured to feed a sheet stored in the paper tray, and a paper conveyance unit configured to convey the sheet fed from the paper feeding device and align the sheet by halting with such a timing as the leading edges of the sheet collides with the halted paper conveyance unit; and a control unit configured to determine the printing suitability of a combination of the sheet stored in a paper tray and one of the paper feed units including this paper tray on the basis of the size and stiffness of the sheet stored in the paper tray. In this case, the plurality of the paper feed units includes at least one first paper feed unit configured in order that the sheet fed from the paper feeding device enters the paper conveyance unit through a conveying route which is curved, and at least one second paper feed unit configured in order that the sheet fed from the paper feeding device enters the paper conveyance unit through a conveying route which is linear.

It is preferred here that the paper feed apparatus further comprises an input unit through which information can be input, wherein the control unit determines the stiffness of a sheet on the basis of the type information of the sheet which is input from the input unit.

Also, it is preferred that the paper feed apparatus further comprises a display unit configured to display information, wherein when the combination is determined as not suitable, the control unit displays information that the paper tray storing the sheet or the sheet stored in the paper tray is to be replaced on the display unit.

Furthermore, it is preferred that when the combination is determined as not suitable, the control unit displays information about another paper tray suitable for storing the sheet, or information about the type of a sheet which is suitable for being stored in the paper tray on the display unit.

Still further, it is preferred that when the combination is determined as not suitable, the control unit displays information which is prompting the user to select whether to perform the print process with the sheet stored in the paper tray without changing on the display unit.

Still further, it is preferred that when the user selects to perform printing with the sheet stored in the paper tray without changing, the control unit sets the speed of conveying the sheet from the paper feeding device to the paper conveyance unit to be slower than a normal speed, and/or sets a halting period during which the sheet halts at the paper conveyance unit to be longer than a normal halting period.

Still further, it is preferred that the paper tray, the paper feeding device and the paper conveyance unit are integrally implemented in each of the plurality of paper feed units which is detachably attached to the body of the paper feed apparatus.

Still further, it is preferred that the plurality of paper feed units are interchangeable in the paper feed apparatus.

BRIEF DESCRIPTION OF DRAWINGS

FIG. 4 is an explanatory view for showing suitable combinations of the stiffness and size of a sheet and a paper feed unit.

DETAILED DESCRIPTION OF THE PREFERRED EMBODIMENT

Figure 1:
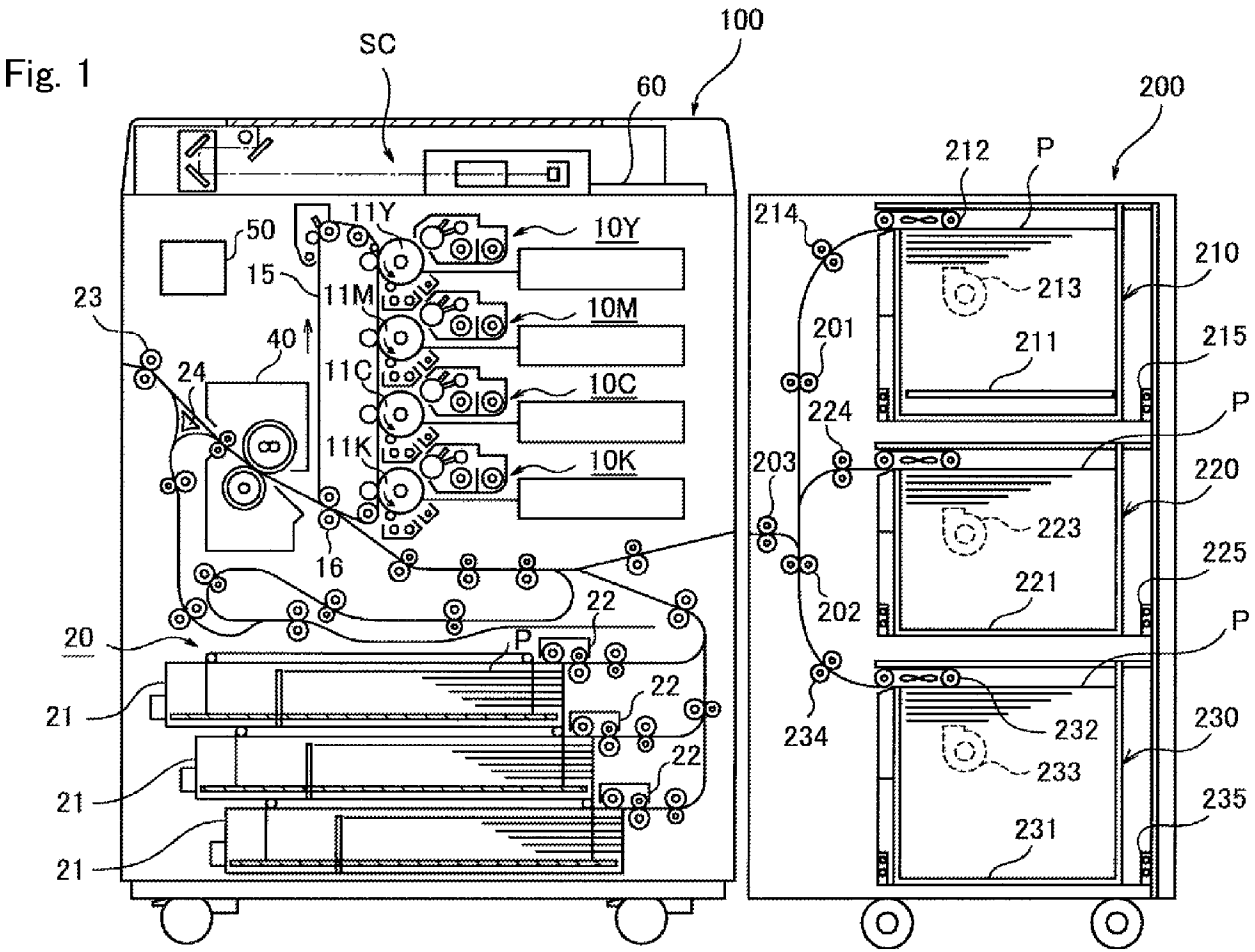
FIG. 1 is an explanatory view for schematically showing the structure of an image forming system in accordance with an embodiment of the present invention.

FIG. 1 is a view for schematically showing the configuration of an image forming system in accordance with the present embodiment. The image forming system is a system which performs various treatments such as image formation on a sheet P conveyed along a conveying route, and consists of a plurality of apparatuses connected in series. The image forming system of the present embodiment includes an image forming apparatus 100 and a large volume paper feed apparatus 200. These apparatuses are arranged in the order as the large volume paper feed apparatus 200 and then the image forming apparatus 100 from the upstream side to the downstream side in the conveying direction of the sheet P.

The image forming apparatus 100 is capable of forming an image on a sheet P fed from the large volume paper feed apparatus 200 or on a sheet P stored in the image forming apparatus 100 itself. The image forming apparatus 100 is, for example, an electrophotographic image forming apparatus called a tandem color image forming apparatus. The tandem color image forming apparatus includes a plurality of photoreceptor drums vertically arranged in contact with one intermediate transfer belt to form full-color images. The image forming apparatus 100 consists mainly of four image forming units 10Y, 10M, 10C and 10K, and a fixing unit 40, which are installed within one housing.

The original reading unit SC scans and exposes the image of an original with an optical system of a scanning exposing device, and reads the reflected light therefrom with a line image sensor to obtain image signals. The image signals are processed by performing A/D conversion, shading compensation, data compression and so on, and input to a control unit 50 as image data. Incidentally, the image data input to the control unit 50 is not limited to the image data as captured by the original reading unit SC, but can be the data for example as received from another image forming apparatus, a personal computer or the like connected to the image forming apparatus, or the data read from a portable medium such as a semiconductor memory.

The four image forming units 10Y, 10M, 10C and 10K are an image forming unit 10Y for forming yellow (Y) images, an image forming unit 10M for forming magenta (M) images, an image forming unit 10C for forming cyan (C) color images, and an image forming unit 10K for forming black (K) images. The image forming units 10Y, 10M, 10C and 10K are provided with photoreceptor drums 11Y, 11M, 11C and 10K. Furthermore, around each of the photoreceptor drums, there are arranged a charging unit, an optical writing unit, a development apparatus and a drum cleaner.

The photoreceptor drums 11Y, 11M, 11C and 10K are uniformly charged with electricity by the charging units, and the optical writing units perform a scanning exposure process to form latent images on the photoreceptor drums 11Y, 11M, 11C and 10K. The development apparatuses then make visible the latent images on the photoreceptor drums 11Y, 11M, 11C and 10K respectively. Predetermined color images (toner images) are thereby formed on the photoreceptor drums 11Y, 11M, 11C and 10K corresponding to yellow, magenta, cyan and black respectively. The images formed on the photoreceptor drums 11Y, 11M, 11C and 10K are transferred by a first transfer roller to a predetermined location of an intermediate transfer belt 15 which is rotated.

After transferred to the intermediate transfer belt 15, the predetermined color images are transferred by a second transfer roller 16 to a sheet P conveyed with a predetermined timing by a paper feed unit 20 to be described below. This second transfer roller 16 and the intermediate transfer belt 15 are arranged in contact with each other and urged against each other to form a transfer nip site.

The paper conveying unit 20 conveys a sheet P fed from the paper feed unit 21 or the large volume paper feed apparatus 200 along the conveying route. In the paper feed unit 21, sheets P are stored in the paper feed tray 21, extracted by a paper feeding device 22 and transferred to the conveyance route. The conveying route is provided with a plurality of paper conveyance units for conveying sheets P. Each paper conveyance unit consists of a pair of rollers which are in contact with each other under pressure, and at least one of the rollers is rotationally driven by a driving mechanism which consists mainly of an electric motor. Then, each conveyance unit holds a sheet P between the pair of rollers which are rotated to convey a sheet P. Meanwhile, in place of a pair of rollers, any other appropriate combination such as a combination of belts, a combination of a belt and a roller or the like combination can be used as a pair of rotary members serving as a conveyance unit.

The fixing unit 40 is a device which performs a fixing process for a sheet P on which an image is transferred, i.e., the sheet P passed from the transfer nip site. The fixing unit 40 consists, for example, of a pair of rollers which are in contact with each other under pressure and a heater for heating either or both of the fixing rollers. This fixing unit 40 fixes the transferred image to a sheet P under the pressure applied by the nip site between the pair of fixing rollers and the heat applied through the fixing rollers when the sheet P is conveyed to pass through the nip site. After the fixing treatment with the fixing unit 40, the sheet P is discharged outwards by a discharging roller 23.

When an image is to be formed also on the back side of a sheet P, the sheet P with the image formed on the front side is conveyed to a refeeding conveyance route through a switch gate 24. The sheet P which is conveyed along the refeed conveying route is held at its tail end by a reversing roller, and then sent back to reverse the front and back sides of the sheet P. After reversing the front and back sides, the sheet P is conveyed by the plurality of conveyance rollers and enters a conveying route in the upstream side of the transfer site to form an image on the other side of the sheet P. Incidentally, the conveyance rollers, the conveying route switch gate, the reversing roller and the like serve to convey sheets P along the refeed conveying route as the components of the paper conveying unit 20 as described above.

The control unit 50 controls the operation of the image forming apparatus 100. The control unit 50 can be implemented with a microcomputer which mainly includes a CPU, a ROM, a RAM and an I/O interface. Also, this control unit 50 controls the overall operation of the image forming system and the operation of the large volume paper feed apparatus 200.

The image forming apparatus 100 is also provided with an operation panel 60 which is an input unit in the form of a touch panel through which users can input setting information with reference to the information displayed on the panel. A user can set the type of a sheet P (paper type such as standard or coated paper, paper density, and thickness), the reduce/enlarge ratio of images, the paper tray to be used as a paper supply source and so forth by operating the operation panel 60. The setting information is acquired by the control unit 50. The operation panel 60 serves also as a display unit which displays a variety of information to the user under the control of the control unit 50.

The large volume paper feed apparatus 200 is a device (PFU) for supplying sheets P to the image forming apparatus 100 and is connected to an upper position of the image forming apparatus 100. The large volume paper feed apparatus is provided with three paper feed units 210, 220 and 230 which are arranged in the vertical direction.

The upper paper feed unit 210 stores a large number of sheets P which are fed, one by one, to the image forming apparatus 100. The paper feed unit 210 consists of a paper tray 211, a paper feeding device 212, an air blowing unit 213, conveyance rollers 214 and guide rails 215.

The paper tray 211 stores a stack of a plurality of sheets P. The paper tray 211 is configured to move up and down by an elevator mechanism which is not shown in the figure, such that the height of the uppermost sheet P of the paper stack is adjusted to be aligned with a predetermined vertical position. Furthermore, the paper tray 211 is configured to be drawn on the guide rails 215 from the large volume paper feed apparatus 200.

The paper feeding device 212 is a paper feed means for outputting a sheet P of the paper stack from the paper tray 211. This paper feeding device 212 includes a drive roller connected to a driving source (not shown in the figure), a non-driven roller and a suction belt which rotates to run around these rollers. There are a number of small holes drilled through the suction belt. An air suction means is provided inside of the suction belt which can therefore convey a sheet P while suctioning the sheet P. When the suction belt rotates while suctioning a sheet P located in an uppermost position of the paper stack on the paper tray 211, the uppermost sheet is transferred to the conveyance rollers 214.

The air blowing unit 213 blows an air flow against the side of the paper stack on the paper tray 211 to rise and float the uppermost sheet P in the air. As a result, the paper feeding device 212 can surely transfer the uppermost sheet P. The air blowing unit 213 is located in each side of the paper stack in the sheet width direction perpendicular to the transfer direction of the sheet P.

The conveyance rollers 214 convey a sheet P fed from the paper feeding device 212, and temporarily halt rotation with such a timing as the leading edge of the sheet P collides with the halted conveyance rollers 214 in order to align the sheet P. The conveyance rollers 214 are a pair of rollers which are in contact with each other under pressure, and arranged on the conveying route of the sheet P. These conveyance rollers 214 are located just behind the paper feeding device 212, and firstly convey the sheet P fed from the paper feeding device 212.

Also, in the same manner as the upper paper feed unit 210, the paper feed unit 220 located in the intermediate position consists of a paper tray 221, a paper feeding device 222, an air blowing unit 223, conveyance rollers 224 and guide rails 225. Furthermore, in the same manner as the upper and intermediate paper feed units 210 and 220, the paper feed unit 230 located in the lower position consists of a paper tray 231, a paper feeding device 232, an air blowing unit 233, conveyance rollers 234 and guide rails 235.

Figure 2A:
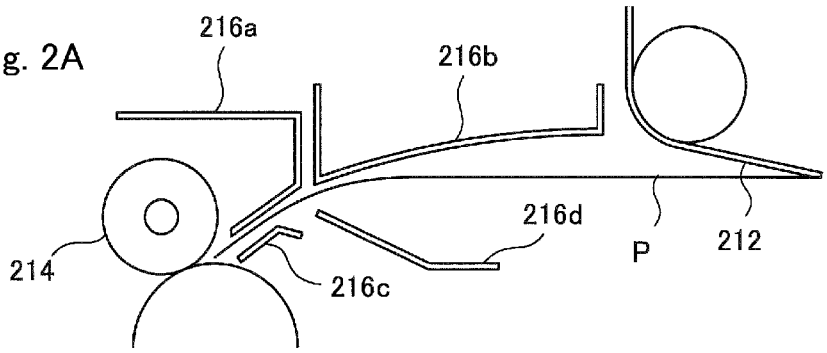
FIGS. 2A, 2B and 2C are expanded explanatory views for showing the main structures of the paper feed units.
Figure 2B:
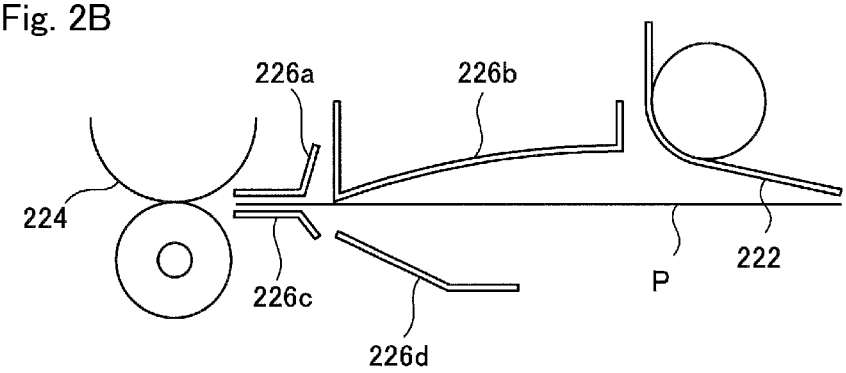
Figure 2C:
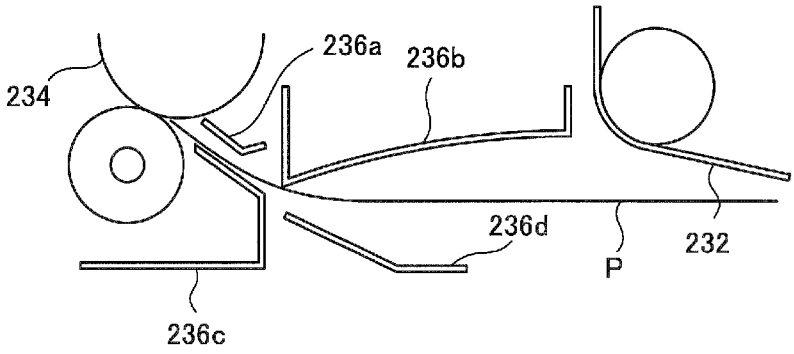

FIGS. 2A, 2B and 2C are expanded explanatory views for showing the main structures of the paper feed units 210, 220 and 230. FIG. 2A shows the upper paper feed unit 210; FIG. 2B shows the intermediate paper feed unit 220; and FIG. 2C shows the lower paper feed unit 230. The present embodiment employs two types of paper feed units for the large volume paper feed apparatus 200, i.e., a first paper feed unit and a second paper feed unit. The first paper feed unit is configured in order that the sheet P fed from a paper feeding device enters conveyance rollers through a conveying route which is curved. On the other hand, the second paper feed unit is configured in order that the sheet P fed from a paper feeding device enters conveyance rollers through a conveying route which is linear.

Specifically, the upper paper feed unit 210 is a first paper feed unit configured in order that the sheet P fed from the paper feeding device 212 enters the conveyance rollers 214 through a conveying route which is curved. Particularly, the upper paper feed unit 210 is a first paper feed unit which makes the sheet P convex upward (refer to FIG. 2A). The curved conveying route is formed, for example, by a plurality of guide members 216*a*, 216*b*, 216*c* and 216*d*. The sheet P fed from the paper feeding device 212 is passed through the curved conveying route and arrived at the conveyance rollers 214 in a curved state.

The intermediate paper feed unit 220 is a second paper feed unit configured in order that the sheet P fed from the paper feeding device 222 enters the conveyance rollers 224 through a conveying route which is linear (refer to FIG. 2B). The linear conveying route is formed, for example, by a plurality of guide members 226*a*, 226*b*, 226*c* and 226*d*. The sheet P fed from the paper feeding device 222 is passed through the linear conveying route and arrived at the conveyance rollers 224 in a straight state.

The lower paper feed unit 230 is a first paper feed unit configured in order that the sheet P fed from the paper feeding device 232 enters the conveyance rollers 234 through a conveying route which is curved. Particularly, the upper paper feed unit 230 is a first paper feed unit which makes the sheet P convex downward (refer to FIG. 2C). The curved conveying route is formed, for example, by a plurality of guide members 236*a*, 236*b*, 236*c* and 236*d*. The sheet P fed from the paper feeding device 232 is passed through the curved conveying route and arrived at the conveyance rollers 234 in a curved state.

In the case of these paper feed units 210, 220 and 230, a sheet P fed from the paper feeding device 212, 222 or 232 tends to get misaligned, for example, lift up, and thereby the position of the sheet P tends to be unsteady. Particularly, this tendency becomes conspicuous in the case where a sheet P is suctioned by air like in the present embodiment. Furthermore, in the case where a conveying route is designed to be linear from a paper feeding device, a sheet P has little interference with the conveying route and can take any position in the conveying route. Because of this, the sheet P enters between conveyance rollers in an unsteady state and thereby tends to be folded or wrinkled. This tendency becomes conspicuous if the sheet P has a small stiffness, such as a thin paper. That is to say, the paper feed unit 220 having the linear conveying route is suitable for conveying a stiff sheet such as a poster board rather than a sheet P having a small stiffness such as a thin paper. This is because, while a sheet P is likely to be misaligned in the linear conveying route, it is expected that the stiffness of the sheet P can inhibit undesirable positional motion. On the other hand, since the paper feed unit 210 or 230 has the curved conveying route, a sheet P is forced to follow the curved route such that the positional disturbance is inhibited. The paper feed units 210 and 230 are thereby suitable for conveying a sheet P having a small stiffness, such as a thin paper, but not suitable for conveying a sheet P having a large stiffness. The first paper feed units 210 and 230 which feed sheets P to the curved routes and the second paper feed unit 220 which feeds sheets P to the linear route have suitable types of sheets P respectively. Namely, it is important to consider the combination of a sheet P and the paper tray in which the sheet P is stored (or the paper feed unit having this paper tray).

Sheets P conveyed through the conveyance rollers 214, 224 and 234 of the paper feed units 210, 220 and 230 are discharged outwards by conveyance rollers 201, 202 and 203 which are located in the downstream side of the conveyance rollers 214, 224 and 234 respectively. The sheets P are then transferred to the apparatus connected in the downstream side.

Figure 3:
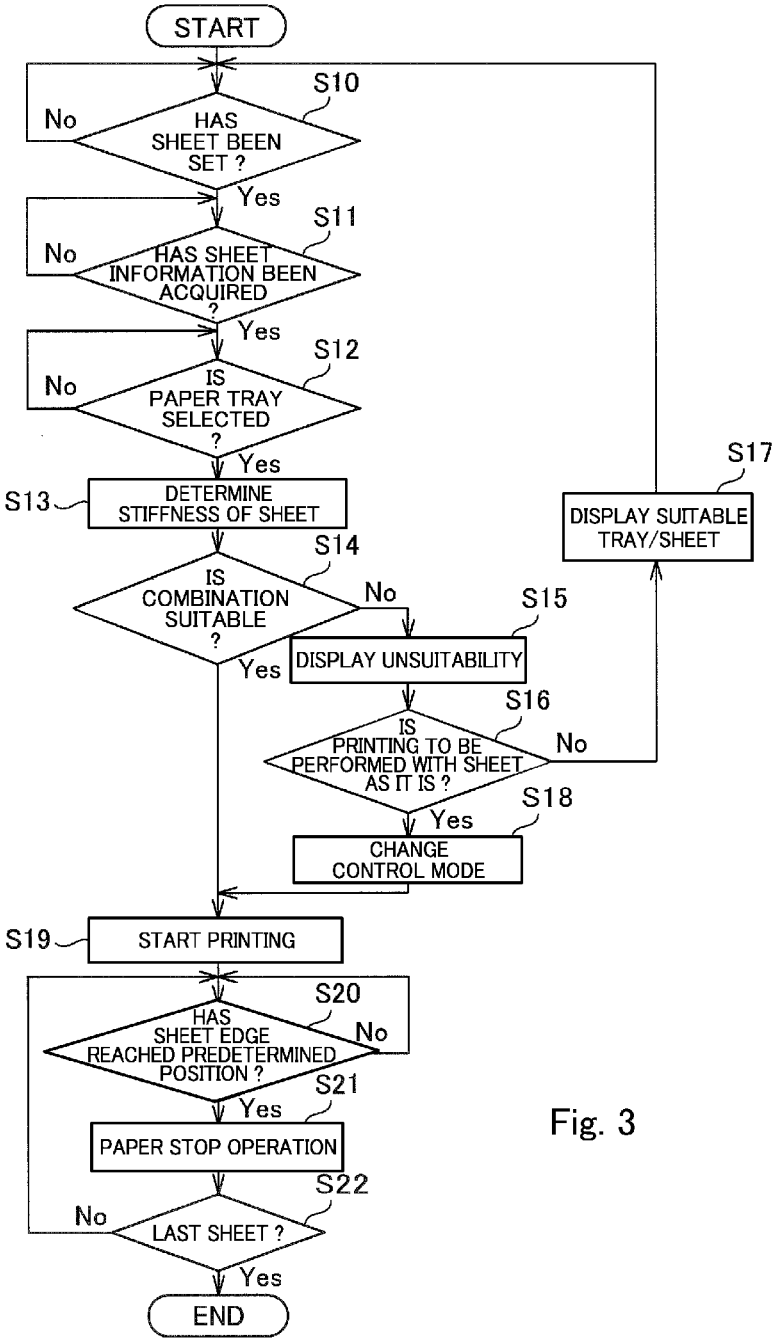
FIG. 3 is a flow chart for showing the procedure of the operation a large volume paper feed apparatus.

Next is a description of the operation of the large volume paper feed apparatus 200 of the image forming system in accordance with the present embodiment. FIG. 3 is a flow chart for showing the procedure of the operation the large volume paper feed apparatus 200. The process based on this flow chart is executed by the control unit 50 of the image forming apparatus 100 in response to the input of a job as a trigger.

First, in step 10 (S10), the control unit 50 determines whether or not a sheet P has been set in any one of the paper trays 211, 221 and 231. When a sheet P has been set in one of the paper trays 211, 221 and 231, the determination is in the affirmative in step 10 so that the process proceeds to step 11 (S11). Conversely, no sheet P has been set in any one of the paper trays 211, 221 and 231, the determination is in the negative in step 10 so that the process returns to step 10. At this time, the control unit 50 displays information that no sheet P has been set in any one of the paper trays 211, 221 and 231 on the operation panel 60.

In step 11, the control unit 50 determines whether or not sheet information has been acquired of the sheet P set on the paper tray 211, 221 or 231. The sheet information is information indicative of the type of the sheet P stored in the paper trays 211, 221 and 231. After a user places sheets P on any one of the paper trays 211, 221 and 231, the user can input this sheet information through the operation panel 60, and the control unit 50 acquires this information. If the control unit 50 has acquired the sheet information, the process proceeds to step 12 (S12). Conversely, if the control unit 50 has not acquired the sheet information yet, the process returns to step 11. The control unit 50 then display information on the operation panel 60 to prompt the user to enter the sheet information of sheets P placed on the paper tray 211, 221 or 231.

In step 12, the control unit 50 determines whether or not one of the paper trays 211, 221 and 231 is selected for feeding a sheet P to be printed. One of the paper trays 211, 221 and 231 is selected by a user in advance of starting a job. If one of the paper trays 211, 221 and 231 is selected, the determination is in the affirmative in step 12 so that the process proceeds to step 13 (S13). Conversely, one of the paper trays 211, 221 and 231 is not selected yet, the determination is in the negative in step 12 so that the process repeats step 12. The control unit 50 then display information on the operation panel 60 to prompt the user to select any one of the paper trays 211, 221 and 231.

In step 13, the control unit 50 determines the stiffness of the sheet P to be printed on the basis of the sheet information of the sheet P. The stiffness of a sheet P is determined on the basis of the characteristics of the sheet P corresponding to the type of the sheet P. The control unit 50 save mapping data indicating the relation between the sheet information and the stiffness obtained in advance through experiments, simulation or the like. The control unit 50 determines the stiffness of the sheet P with reference to the relation on the basis of the sheet information.

In step 14 (S14), the control unit 50 determines whether or not the sheet P stored in the paper tray 211, 221 or 231 to be used for printing is suitable for the paper feed unit 210, 220 or 230 corresponding to this paper tray 211, 221 or 231. Since each of the paper feed units 210, 220 and 230 have a suitable type of sheets P in accordance with the configuration of the conveying route from the paper feeding device to the conveyance rollers corresponding to this each paper feed unit, as has been discussed above, the control unit 50 determines if the sheet P stored in the paper tray to be printed matches the paper feed unit corresponding to this paper tray. As illustrated in FIG. 4, the control unit 50 saves a map or the like table for determining the paper feed unit which matches each type of sheets P on the basis of the size and stiffness of the sheets P to be printed. In the same figure, "A" indicates that a linear paper feed unit is suitable; "B" indicates that a curved paper feed unit is suitable; and "A/B" indicates that either a linear paper feed unit or a curved paper feed unit is suitable.

The control unit 50 identifies the type of a paper feed unit suitable for printing the sheet P with reference to the map on the basis of the stiffness of the sheet P obtained in step 13 and the size of the sheet P detected by a detection unit which is not shown in the figure, and determines whether or not the paper feed unit corresponding to the selected paper tray is of the suitable type. If the selected paper tray 211, 221 or 231 and the identified suitable type match, the control unit 50 determines that suitable sheets P are stored in the paper tray 211, 221 or 231 for use in printing, i.e., the determination in step 14 is in the affirmative, the process proceeds to step 19 (S19) to be described below. On the other hand, if the selected paper tray 211, 221 or 231 and the identified suitable type does not match, i.e., if the determination in step 14 is in the negative, the process proceeds to step 15 (S15).

In step 15, the control unit 50 displays information indicating that the selected paper tray 211, 221 or 231 is not suitable for use in printing on the sheets P stored in this paper tray on the operation panel 60.

In step 16 (S16), the control unit 50 determines whether or not the print process is performed with the sheets P stored in the selected paper tray 211, 221 or 231 as designated. Specifically speaking, the control unit 50 displays information prompting the user to make this determination on the operation panel 60, and receives the determination of the user through the operation panel 60. If the determination is in the negative in step 16, i.e., the print process is not to be performed, the process proceeds to step 17 (S17). On the other hand, if the determination is in the affirmative in step 16, i.e., the print process is to be performed as designated, the process proceeds to step 18 (S18).

In step 17 (S17), the control unit 50 controls the operation panel 60 to display information about the paper tray 211, 221 or 231 which is suitable for storing the sheets P, or information about the type of sheets P which is suitable for being stored in the paper tray 211, 221 or 231 which has been designated for printing.

In step 18 (S18), on the other hand, the control unit 50 switches the control mode of the large volume paper feed apparatus 200 from a normal mode to a stable mode. When this stable mode is selected, the speed of conveying sheets from the paper feeding device 212, 222 or 232 to the conveyance rollers 214, 224 or 234 is set to be slower than the conveying speed selected in the normal mode, and/or the halting period of a paper stop operation to be described below is set to be longer than the halting period selected in the normal mode.

In step 19 (S19), the control unit 50 performs the print process, and starts conveying the sheets P from the uppermost sheet in the selected paper tray 211, 221 or 231.

In step 20 (S20), the control unit 50 determines whether or not the leading edge of a sheet P has reached a predetermined position before the conveyance rollers 214, 224 or 234 with reference to the output of a sheet detection sensor (not shown in the figure) which is located in the predetermined position. If the determination is in the affirmative in step 20, i.e., the leading edge of the sheet P has reached the predetermined position, the process proceeds to step 21 (S21). On the other hand, if the determination is in the negative in step 21, i.e., the leading edge of the sheet P has not reached the predetermined position yet, step 20 is repeated.

In step 21, the control unit 50 performs the paper stop operation. Specifically speaking, the control unit 50 temporarily halts rotation of the conveyance rollers 214, 224 or 234 just before the leading edge of the sheet P collides with the conveyance rollers 214, 224 or 234. After fed from the paper feeding device 212, 222 or 232, thereby, the sheet P stops when colliding with the conveyance rollers 214, 224 or 234 which is halting rotation. The paper feeding device 212, 222 or 232 continues its feeding operation a predetermined period after the leading edge of the sheet P collides with the conveyance rollers 214, 224 or 234, and then halts its feeding operation. The paper P is thereby warped in the form of a loop, and can be properly aligned. The conveyance rollers 214, 224 or 234 then resume the rotation with a predetermined timing to transfer the sheet P to the image forming apparatus 100 through the conveyance rollers 201, 202 or 203 located in the downstream side of the conveyance rollers 214, 224 or 234.

In step 22 (S22), the control unit 50 determines whether or not the sheet P just transferred by the paper feeding device 212, 222 or 232 is the last sheet of the print job. If the determination is in the affirmative in step 22 (S22), i.e., if the sheet P is the last sheet, the process ends. Conversely, if the determination is in the negative in step 22, i.e., if the sheet P is not the last sheet, the process is returned to step 22.

In the case of the present embodiment, as has been discussed above, the large volume paper feed apparatus 200 includes the plurality of paper feed units 210, 220 and 230, and the control unit 50 which determines the suitability of sheets P stored in the paper tray 211, 221 or 231 for printing with the paper feed unit 210, 220 or 230 accompanied with the paper tray 211, 221 or 231 on the basis of the size and stiffness of the sheets P stored in the paper tray 211, 221 or 231. Particularly, the paper feed units 210, 220 and 230 includes the paper trays 211, 221 and 231, the paper feeding devices 212, 222 and 232 for feeding sheets P stored in the paper trays 211, 221 and 231, and the conveyance rollers 214, 224 and 234 (paper conveyance units) for conveying sheets P fed from the paper feeding devices 212, 222 and 232 and aligning the sheets P by halting with such a timing as the leading edges of the sheets P collides with the conveyance rollers 214, 224 and 234 having halted, respectively.

The plurality of paper feed units 210, 220 and 230 includes two types of paper feed units, i.e., the first paper feed units 210 and 230 which are configured in order that the sheets P fed from the paper feeding devices 212 and 232 enter the conveyance rollers 214 and 234 through the conveying routes which are curved, and the second paper feed unit 220 which is configured in order that the sheet P fed from the paper feeding device 222 enters the conveyance rollers 224 through the conveying route which is linear.

Namely, there are provided the first paper feed units 210 and 230 which feed sheets P along the curved conveying routes which are suitable for feeding a sheet P having a small stiffness, and the second paper feed unit 220 which feeds sheets P along the linear conveying route which is suitable for feeding a sheet P having a large stiffness. It is therefore possible to feed various types of sheets in appropriate manners respectively by selecting a suitable one of the paper feed units 210, 220 and 230 in accordance with the type of each sheet P. Incidentally, if the user has to make such a selection, sheets P may be placed on a paper tray which is not suitable for the sheets P. However, by checking sheets P stored in the paper tray 211, 221 or 231, it is avoided that a sheet P is fed from the paper tray 211, 221 or 231 which is not suitable for the sheet P. As a result, improper conveyance of sheets P can be avoided.

That is to say, by considering individual units from the paper feeding devices 212, 222 and 232 to the downstream side conveyance rollers 214, 224 and 234, two different types of conveyance routes, i.e., the curved conveying route and the linear conveying route are intentionally implemented in the large volume paper feed apparatus 200 of the present embodiment which can thereby be effectively operated by determining the suitability of sheets P for the route corresponding to the paper feeding devices 212, 222 and 232 for feeding the sheets P. In the past, the conveyance rollers provided in the downstream side of a paper feeding device have not been located in accordance with the technical concept as has been discussed above, but have necessarily located in particular positions in accordance with the configurations of the conveying routes arranged in the apparatus.

The control unit 50 determines the stiffness of a sheet P on the basis of the type information of the sheet P which is input through the operation panel 60.

The stiffness of a sheet P can be determined in correspondence with the type of the sheet P, and thereby determined on the basis of the type information of the sheet P which is input through the operation panel 60.

Also, when it is determined that the sheets P for printing and the paper tray 211, 221 or 231 which stores the sheets P is not suitable, the control unit 50 of the present embodiment displays, on the operation panel 60, that it is required to change the paper tray 211, 221 or 231 for storing the sheets P or replace the sheets P for printing with other sheets.

By this configuration, the user can be readily notified that it is required to change the combination of the sheets P and the paper tray 211, 221 or 231 for storing the sheets P.

Meanwhile, in this case, the control unit 50 may display, on the operation panel 60, information about the other paper tray 211, 221 or 231 suitable for storing the sheets P, or information about the type of sheets P suitable for being stored in the paper tray 211, 221 or 231 which has been designated for printing.

In the case where there are the plurality of paper trays 211, 221 and 231, since a user may not know which combination of a paper tray and a type of sheets is suitable, it is effective to notify the user of suitable combinations.

Furthermore, after determining that the combination is not suitable, the control unit 50 of the present embodiment displays, on the operation panel 60, information which is prompting the user to select whether to perform the print process with the sheet P stored in the paper tray 211, 221 or 231 without changing.

By this configuration, the will of a user can be reflected in the operation of the apparatus.

Also, when the user selects to perform the print process with the sheet P stored in the paper tray 211, 221 or 231 without changing, the control unit 50 of the present embodiment sets the speed of conveying sheets from the paper feeding device 212, 222 or 232 to the conveyance rollers 214, 224 or 234 to be slower than the normal speed, and/or sets the halting period during which the sheet P halts at the conveyance rollers 214, 224 or 234 to be longer than the normal period.

Misalignment of a sheet P can be inhibited by the above control even when the sheet P is fed from a paper tray which is not suitable for this sheet P. It is therefore possible to inhibit a sheet P from being folded or wrinkled.

Alternatively, in the case of the large volume paper feed apparatus 200 of the present embodiment, each of the plurality of paper feed units 210, 220 and 230 may be detachably attached to the body of the large volume paper feed apparatus 200 by integrating the paper trays 211, 221 and 231, the paper feeding devices 212, 222 and 232 and the conveyance rollers 214, 224 and 234 respectively. The paper feed units 210, 220 and 230 can thereby be replaced separately in each unit.

Also, in this case, the plurality of paper feed units 210, 220 and 230 are configured to replace each other in the large volume paper feed apparatus 200. By this configuration, users are allowed to use the paper feed units 210, 220 and 230 in desired ways, for example, to place the frequently-used paper feed unit in the upper position where the user can easily access without need for bending over from the waist.

The foregoing description has been presented on the basis of the image forming system according to the embodiments of the present invention. However, it is not intended to limit the present invention to the precise form described, and obviously many modifications and variations are possible within the scope of the invention.

For example, the present invention can be considered to relate also to the paper feed apparatus (the large volume paper feed apparatus) itself as a part of the image forming system. Furthermore, the paper feed apparatus need not be implemented alone, but can be constructed as an embedded part of an image forming apparatus to which the present invention can be applied. In this case, this image forming apparatus itself embodies the present invention. Still further, the paper feeding device is not limited to an air suction type but can be a device which drags the uppermost sheet with rollers.

What is claimed is:

1. A paper feed apparatus comprising:

a first paper feed unit which includes a first paper tray, a first paper feeding device structured to feed a sheet stored in the first paper tray, and a first paper conveyance unit structured to convey the sheet fed from the first paper feeding device and align the sheet by halting with such a timing as the leading edge of the sheet collides with the halted first paper conveyance unit, wherein the sheet fed from the first paper feeding device enters the first paper conveyance unit through a first conveying route which is curved;

a second paper feed unit which includes a second paper tray, a second paper feeding device structured to feed a sheet stored in the second paper tray, and a second paper conveyance unit structured to convey the sheet fed from the second paper feeding device and align the sheet by halting with such a timing as the leading edge of the sheet collides with the halted second paper conveyance unit, wherein the sheet fed from the second paper feeding device enters the second paper conveyance unit through a second conveying route which is different than the first conveying route in curving condition;

an acquisition unit structured to acquire the information about at least the size and stiffness of the sheet stored in the first paper tray; and a control unit structured to determine the printing suitability of a combination of the sheet stored in the first paper tray and the first paper feed unit including the first paper tray on the basis of the acquired information about the size and stiffness of the sheet stored in the first paper tray and determination criteria which are stored in advance.

2. The paper feed apparatus of claim 1 further comprising an input unit through which information can be input, wherein the acquisition unit determines the stiffness of the sheet on the basis of the type information of the sheet which is input from the input unit.

3. The paper feed apparatus of claim 1 further comprising a display unit structured to display information, wherein when the combination is determined as not suitable, the control unit displays information that the paper tray storing the sheet or the sheet stored in the paper tray is to be replaced on the display unit.

4. The paper feed apparatus of claim 3 wherein when the combination is determined as not suitable, the control unit displays information about another paper tray suitable for storing the sheet, or information about the type of a sheet which is suitable for being stored in the paper tray on the display unit.

5. The paper feed apparatus of claim 1 further comprising a display unit structured to display information, wherein when the combination is determined as not suitable, the acquisition unit displays information which is prompting the user to select whether to perform the print process with the sheet stored in the paper tray without changing on the display unit.

6. The paper feed apparatus of claim 5 wherein when the user selects to perform the printing process with the sheet stored in the paper tray without changing, the control unit sets the speed of conveying the sheet from the paper feeding device to the paper conveyance unit to be slower than a normal speed, or sets a halting period during which the sheet halts at the paper conveyance unit to be longer than a normal halting period.

7. The paper feed apparatus of claim 1 wherein the paper tray, the paper feeding device and the paper conveyance unit are integrally implemented in each of the plurality of paper feed units which is detachably attached to the body of the paper feed apparatus.

8. The paper feed apparatus of claim 7 wherein the plurality of paper feed units are interchangeable in the paper feed apparatus.

9. The paper feed apparatus of claim 1, further comprising a detecting unit structured to detect a paper size, wherein the acquisition unit acquires the size of the sheet through the detecting unit.

10. The paper feed apparatus of claim 1, wherein the second conveying route is a linear route.

11. An image forming apparatus comprising:

a first paper feed unit which includes a first paper tray, a first paper feeding device structured to feed a sheet stored in the first paper tray, and a first paper conveyance unit structured to convey the sheet fed from the first paper feeding device and align the sheet by halting with such a timing as the leading edge of the sheet collides with the halted first paper conveyance unit, wherein the sheet fed from the first paper feeding device enters the first paper conveyance unit through a first conveying route which is curved;

a second paper feed unit which includes a second paper tray, a second paper feeding device structured to feed a sheet stored in the second paper tray, and a second paper conveyance unit structured to convey the sheet fed from the second paper feeding device and align the sheet by halting with such a timing as the leading edge of the sheet collides with the halted second paper conveyance unit, wherein the sheet fed from the second paper feeding device enters the second paper conveyance unit through a second conveying route which is different than the first conveying route in curving condition;

an acquisition unit structured to acquire the information about at least the size and stiffness of the sheet stored in the first paper tray;

an image forming unit structured to form an image on a sheet which is fed from the first paper feed unit or the second paper feed unit; and a control unit structured to determine the printing suitability of a combination of the sheet stored in the first paper tray and the first paper feed unit including first paper tray on the basis of the acquired information about the size and stiffness of the sheet stored in the first paper tray and determination criteria which are stored in advance.

12. The image forming apparatus of claim 11 further comprising an input unit through which information can be input, wherein the acquisition unit determines the stiffness of the sheet on the basis of the type information of the sheet which is input from the input unit.

13. The image forming apparatus of claim 11 further comprising a display unit structured to display information, wherein when the combination is determined as not suitable, the control unit displays information that the paper tray storing the sheet or the sheet stored in the paper tray is to be replaced on the display unit.

14. The image forming apparatus of claim 13 wherein when the combination is determined as not suitable, the control unit displays information about another paper tray suitable for storing the sheet, or information about the type of a sheet which is suitable for being stored in the paper tray on the display unit.

15. The image forming apparatus of claim 11 further comprising a display unit structured to display information, wherein when the combination is determined as not suitable, the acquisition unit displays information which is prompting the user to select whether to perform the print process with the sheet stored in the paper tray without changing on the display unit.

16. The image forming apparatus of claim 15 wherein when the user selects to perform the printing process with the sheet stored in the paper tray without changing, the control unit sets the speed of conveying the sheet from the paper feeding device to the paper conveyance unit to be slower than a normal speed, or sets a halting period during which the sheet halts at the paper conveyance unit to be longer than a normal halting period.

17. The image forming apparatus of claim 11 wherein the paper tray, the paper feeding device and the paper conveyance unit are integrally implemented in each of the plurality of paper feed units which is detachably attached to the body of the image forming apparatus.

18. The image forming apparatus of claim 17 wherein the plurality of paper feed units are interchangeable in the image forming apparatus.

19. The image forming apparatus of claim 11, further comprising a detecting unit structured to detect a paper size, wherein the acquisition unit acquires the size of the sheet through the detecting unit.

20. The image forming apparatus of claim 11, wherein the second conveying route is a linear route.

21. An image forming system comprising:

a paper feed apparatus;

an image forming apparatus structured to form an image on a sheet which is fed from the paper feed apparatus; and a control unit, wherein the paper feed apparatus comprising:

a first paper feed unit which includes a first paper tray, a first paper feeding device structured to feed a sheet stored in the first paper tray, and a first paper conveyance unit structured to convey the sheet fed from the first paper feeding device and align the sheet by halting with such a timing as the leading edge of the sheet collides with the halted first paper conveyance unit, wherein the sheet fed from the first paper feeding device enters the first paper conveyance unit through a first conveying route which is curved;

a second paper feed unit which includes a second paper tray, a second paper feeding device structured to feed a sheet stored in the second paper tray, and a second paper conveyance unit structured to convey the sheet fed from the second paper feeding device and align the sheet by halting with such a timing as the leading edge of the sheet collides with the halted second paper conveyance unit, wherein the sheet fed from the second paper feeding device enters the second paper conveyance unit through a second conveying route which is different than the first conveying route in curving condition; and an acquisition unit structured to acquire the information about at least the size and stiffness of the sheet stored in the first paper tray; wherein the control unit structured to determine the printing suitability of a combination of the sheet stored in the first paper tray and the first paper feed unit including the first paper tray on the basis of the acquired information about the size and stiffness of the sheet stored in the first paper tray and determination criteria which are stored in advance.

22. The image forming system of claim 21 further comprising an input unit through which information can be input, wherein the acquisition unit determines the stiffness of the sheet on the basis of the type information of the sheet which is input from the input unit.

23. The image forming system of claim 21 further comprising a display unit structured to display information, wherein when the combination is determined as not suitable, the control unit displays information that the paper tray storing the sheet or the sheet stored in the paper tray is to be replaced on the display unit.

24. The image forming system of claim 23 wherein when the combination is determined as not suitable, the control unit displays information about another paper tray suitable for storing the sheet, or information about the type of a sheet which is suitable for being stored in the paper tray on the display unit.

25. The image forming system of claim 21 further comprising a display unit structured to display information, wherein when the combination is determined as not suitable, the acquisition unit displays information which is prompting the user to select whether to perform the print process with the sheet stored in the paper tray without changing on the display unit.

26. The image forming system of claim 25 wherein when the user selects to perform the printing process with the sheet stored in the paper tray without changing, the control unit sets the speed of conveying the sheet from the paper feeding device to the paper conveyance unit to be slower than a normal speed, or sets a halting period during which the sheet halts at the paper conveyance unit to be longer than a normal halting period.

27. The image forming system of claim 21 wherein the paper tray, the paper feeding device and the paper conveyance unit are integrally implemented in each of the plurality of paper feed units which is detachably attached to the body of the paper feed apparatus.

28. The image forming system of claim 27 wherein the plurality of paper feed units are interchangeable in the paper feed apparatus.

29. The image forming system of claim 21, further comprising a detecting unit structured to detect a paper size, wherein the acquisition unit acquires the size of the sheet through the detecting unit.

30. The image forming system of claim 21, wherein the second conveying route is a linear route.

* * * * *